United States Patent [19]

Leach

[11] Patent Number: 4,486,734

[45] Date of Patent: Dec. 4, 1984

[54] HIGH VOLTAGE ELECTRIC FUSE

[75] Inventor: John G. Leach, Hickory, N.C.

[73] Assignee: General Electric Company, King of Prussia, Pa.

[21] Appl. No.: 483,391

[22] Filed: Apr. 8, 1983

[51] Int. Cl.[3] ..... H01H 85/04

[52] U.S. Cl. ..... 337/162; 337/158; 337/160

[58] Field of Search ..... 337/158, 159, 160, 161, 337/162, 166

[56] References Cited

U.S. PATENT DOCUMENTS

| | | | |
|---|---|---|---|
| 1,927,397 | 9/1933 | Girdwood | 337/220 |
| 2,800,554 | 7/1957 | Dannenberg et al. | 337/158 |
| 3,705,373 | 12/1972 | Cameron | 337/160 |
| 3,958,206 | 5/1976 | Klint | 337/160 |
| 4,357,588 | 11/1982 | Leach et al. | 337/160 |
| 4,388,603 | 6/1983 | Hassler et al. | 337/162 |

*Primary Examiner*—Harold Broome
*Attorney, Agent, or Firm*—William Freedman

[57] ABSTRACT

This high voltage fuse comprises a pair of spaced terminals and a fusible conductive element connected between the terminals. At spaced locations along the length of the fusible element, there are bodies of a material that exothermically reacts when heated to a predetermined temperature. Connected between the terminals independently of the fusible element is a triggering circuit. The bodies of exothermic material are connected in good heat-transfer relationship with the triggering circuit and the fusible element so that the heating effect of current through the triggering circuit upon disruption of the fusible element causes the material of said bodies to exothermically react and thus cause further disruption of the fusible element at additional locations respectively located adjacent said bodies.

17 Claims, 5 Drawing Figures

HIGH VOLTAGE ELECTRIC FUSE

BACKGROUND OF THE INVENTION

This invention relates to an electric fuse, and more particularly, to a high voltage current-limiting fuse that is capable of interrupting a wide range of currents and is especially suited for low current interruption.

The usual high voltage current-limiting fuse comprises at least one fusible conductive element connected in series with the circuit being protected. When a overcurrent flows through the fusible element for a predetermined duration, the fusible element melts at one or more restricted locations along its length, establishing an arc in each region where melting occurs. If such a fuse is operated by a low current, such as 1.5 times its continuous current rating, only a single arc might be created in response to the overcurrent condition.

The formation of only a single arc presents problems for a high voltage fuse. For example, for a fuse to successfully interrupt 15 kV using a single arc, the arc length must be rapidly increased to a relatively great value in the range of 25.4 to 76.2 cm (10 to 30 inches). Moreover, this relatively long single arc must be developed within a few cycles of power frequency current, or the electric field in the arc will diminish to an unacceptably low value, and the fuse will fail to clear. Developing such a long arc within the required time is not usually feasible, considering the slowness with which the arc will elongate when the current density is low. Accordingly, it is desired that more than one arc be created along a fuse element in response to low overcurrents producing operation of a high voltage fuse at voltages above about 1 kV.

Various means are known to establish multiple breaks for a high voltage fuse element in order to facilitate clearing for low current fault interruption. One such means is taught in my U.S. Pat. No. 4,357,588, assigned to the same assignee of the present invention, and herein incorporated by reference.

U.S. Pat. No. 4,357,588 describes fuse elements including various reduced cross-section portions having a desired fusible time-current characteristic which causes rupturing of the fuse elements and which fuse elements are especially suited for low current fault interruption. Although the reduced cross-sectional portions of the fuse elements provide for the desired low current interruption, the operation of these fuse elements is hindered inasmuch as there is a minimum current density in the reduced cross-section portions below which multiple melting will not occur. This current density corresponds to a melting time of 1–2 hours.

There is a requirement for a fuse to be capable of clearing currents which cause melting in times longer than 1–2 hours, and indeed it is desirable that a fuse be capable of clearing any current which causes its element(s) to open. This should include cases where the fuse elements have been damaged, for example, by a large surge current, and the fuse actually opens when carrying less than its rated current. It is toward this end that the present invention is directed.

Another approach for achieving multiple breaks in response to persistent overcurrents of low value is disclosed in U.S. Pat. No. 3,705,373—Cameron. Cameron provides a main fusible conductive element and an auxiliary conductive element electrically connected to the main element at at least two spaced points along its length. The auxiliary element is made entirely or at least partially of high-resistivity exothermic material so that current normally flows through the main fusible element. If, in response to an overcurrent, the main fusible element melts at a location between said two points, current is diverted into the auxiliary element, causing the material of the auxiliary element to exothermically react. Since the auxiliary element is closely adjacent or touching the main fusible element, the exothermic reaction heats the main fusible element and causes it to melt at one or more locations in addition to the first location.

This fuse has a number of significant disadvantages. One is that the exothermic material must be conductive to allow it to be formed as a conductive element, and this limits the type and quantity of the exothermic material that can be selected for such use. Another disadvantage is that a relatively large quantity of exothermic material is needed to effect melting of the relatively large fusible element present in a high current fuse; and the presence of this large quantity of conductive exothermic material results in an undesirable parallel conductive path close to the main fusible element after fuse operation, and this would be detrimental to final clearing of the fuse. Still another disadvantage is that in the case of a fuse with multiple main fusible elements in parallel, a plurality of auxiliary elements of exothermic material, one for each main fusible element, would be needed. Still another disadvantage is that the auxiliary element cannot respond to all breaks in the main fusible element. For example, should a break occur in the main fusible element only in a location outside the region spanned by the auxiliary element, the auxiliary element would fail to respond since it would still be shunted by an intact portion of the low resistance main fusible element. Still another disadvantage of the Cameron design is that the auxiliary element must be closely adjacent the main element in order to effect a consistent response of the main element following the exothermic reaction.

SUMMARY

An object of my invention is to provide a high voltage fuse which utilizes exothermic material for developing multiple arcs in series in response to low overcurrents but yet is not subject to most of the disadvantages set forth in the immediately preceding paragraph.

Another object is to provide a high voltage fuse which is capable of clearing any current which is likely to cause its fusible element(s) to open.

Still another object is to provide a high voltage fuse comprising a main fusible element and, paralleling the main fusible element, a trigger circuit operable upon conduction of significant current to ignite bodies of exothermic material to develop multiple breaks in the main fusible element.

Another object is to preclude the trigger circuit of such a fuse from operating in response to surge currents through the main fusible element that might develop appreciable voltage across the trigger circuit.

In carrying out my invention in one form, I provide a high voltage fuse that comprises a pair of spaced-apart conductive terminals and a fusible conductive element connected between said terminals. At spaced-apart locations along the length of the fusible conductive element, I provide bodies of exothermic material, such material having the property of exothermically reacting when heated to a predetermined temperature. Connected between the terminals independently of the fusible conductive element is a triggering circuit having a resistance that limits current therethrough to very low values until the fusible conductive element is disrupted. The bodies of exothermic material are connected in good heat-transfer relationship with the triggering circuit and the fusible conductive element so that the heating effect of current through the triggering circuit upon disruption of the fusible conductive element causes the material of said bodies to exothermically react and thus cause further disruption of the fusible element at additional locations respectively located adjacent said bodies. Means is provided for electrically insulating the triggering circuit from the fusible element at all points along the length of the fusible element except at the terminals.

BRIEF DESCRIPTION OF DRAWINGS

For a better understanding of the invention, reference may be had to the following description taken in conjunction with the accompanying drawings, wherein.

DETAILED DESCRIPTION OF PREFERRED EMBODIMENTS

Figures 1, 2, 3, 4, 5:
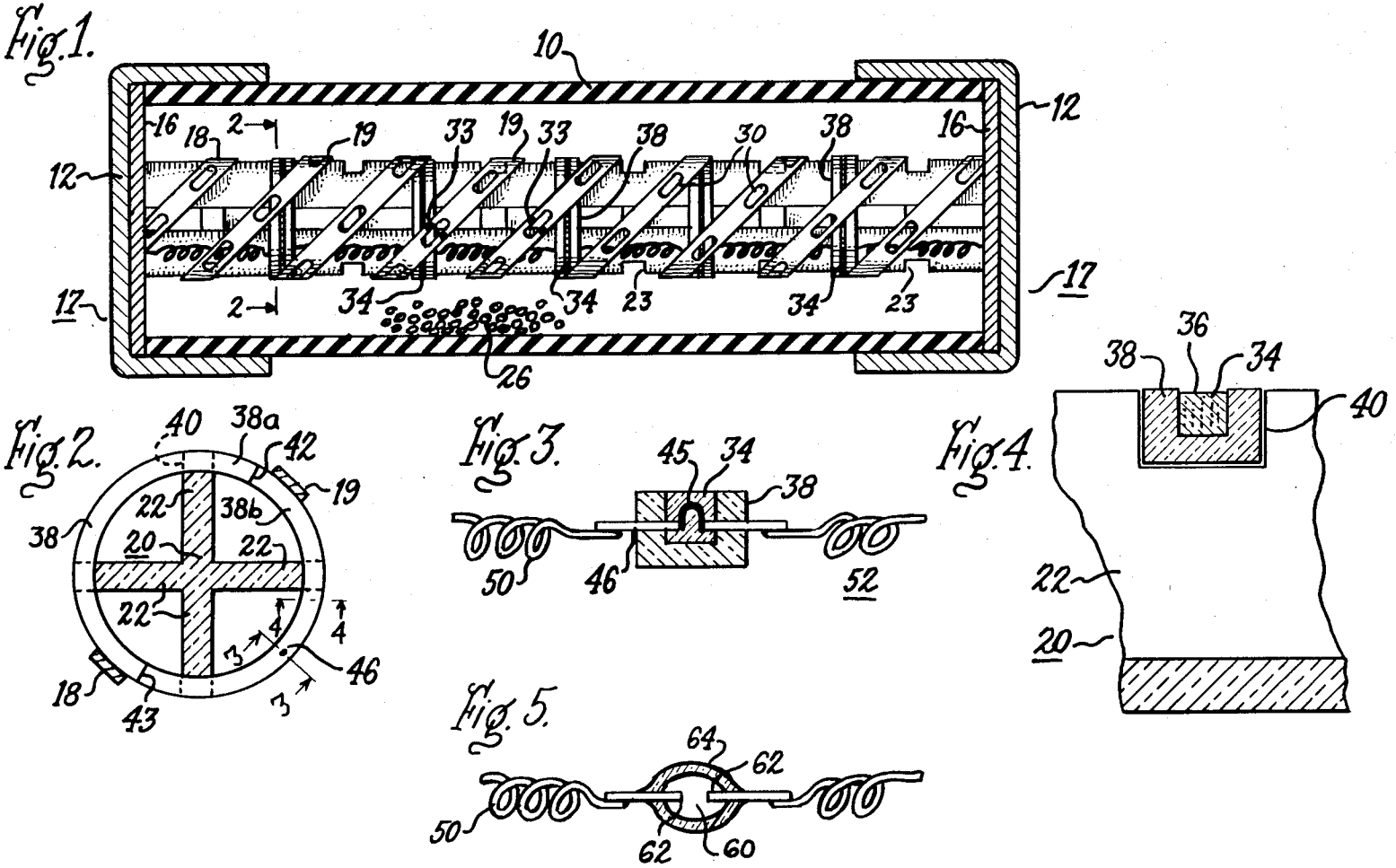
FIG. 1 is a cross-sectional view through a high voltage current-limiting fuse embodying one form of my invention.
FIG. 2 is a sectional view taken along the line 2—2 of FIG. 1.
FIG. 3 is a sectional view taken along the line 3—3 of FIG. 2.
FIG. 4 is a sectional view taken along the line of 4—4 of FIG. 2.
FIG. 5 shows a modified embodiment of the invention.

Referring now to FIG. 1, the high voltage current-limiting fuse depicted therein comprises a tubular casing 10 of electrical insulating material and two conductive end caps 12 mounted on the casing at its respective opposite ends. Clamped between each end cap and the end of the casing is a conductive terminal plate 16, soon to be described in more detail. Each end cap 12 and its associated terminal plate 16 taken together constitute a fuse terminal 17.

Extending between the spaced-apart fuse terminals 17 and electrically connected thereto are a plurality of fusible conductive elements 18 and 19 electrically in parallel with each other. These fusible elements 18 and 19 are supported on a core 20 of insulating material located centrally of casing 10 and also extending between the terminals and suitably supported thereon. In the illustrated embodiment, the core 20 is of a cross-shaped transverse cross-section, as shown in FIG. 2, and comprises four fins 22 extending along the length of the core and radiating from its central region. The fusible conductive elements 18 and 19 are spirally wound about the core in spaced relationship to each other. Notches 23 are provided in the outer edges of the fins 22 to provide added creepage distance along the edges to improve the ability of the core to withstand voltages applied along the core length. This ability may be further improved by providing additional notches along the outer edges, with at least one notch being interposed between adjacent elements at each location where the elements contact the core.

The fusible elements 18 and 19 are electrically connected to the terminals in a suitable conventional manner, as by having an extended portion at each end clamped between the associated conductive end cap 12 and the adjacent terminal plate 16. For simplicity, these conventional details are not illustrated in the drawings.

In a preferred embodiment, the insulating casing 10 is filled with a pulverulent arc-extinguishing material 26 such as quartz sand. This sand surrounds the fusible elements on all sides except where they are in contact with the core and with certain ring structure 34, 38 (soon to be described) attached to the core. This sand serves in a conventional manner to cool arcing products and to extinguish arcs that are developed when the fuse elements are disrupted by melting or vaporization.

Each fusible element 18 and 19 has cut-outs 30 located at spaced locations along its length to form regions of reduced cross-section. Some or all of these cut-outs can be of appropriate shapes other than those shown, e.g., they can be circular or they can be in the form of edge notches. In the event of a short-circuit in the protected circuit, a high current flows through the fusible elements, causing the fusible elements to rapidly melt and vaporize at these regions of reduced cross-section, forming series-related arcs along the length of the fuse elements. The arcing products are cooled by the surrounding sand, and the arcs are extinguished in a conventional manner to effect circuit interruption.

To assist in initiating fuse operation under low current conditions, each of the fusible elements in the illustrated embodiment is provided with a conventional "M-effect" producing overlay 33 adjacent one of its cutouts 30. When the fusible element is heated by an overcurrent that persists for a predetermined duration, the overlay begins to melt and alloy with the adjacent metal of the fusible element. This increases the resistance of the fusible element at this location, accelerating melting at this location. When the last of the fusible elements melts, an arc is formed at this location.

As pointed out hereinabove, it is not usually feasible to interrupt low current in a high voltage circuit with such a single arc, and an object of my invention is to rapidly produce additional arcs in series with the first arc to assist in interrupting the low current. To this end, I provide at spaced locations along the length of the core 20 bodies of exothermic material which are ignited in response to disruption of the fusible elements 18, 19 by melting or otherwise.

The bodies of exothermic material are shown at 34 in FIGS. 1, 3, and 4. Each of these bodies is contained within an annular groove 36 formed in an annular ceramic ring 38. The groove 36 has its open side facing in a radially-outward direction. Each ring 38 is made up of two semi-circular components 38*a* and 38*b* which are fitted within notches 40 in the outer periphery of the core fins. The two semi-circular components 38*a* and 38*b* are suitably held together to form a complete ring as by cementing their opposed ends at locations 42 and 43 shown in FIG. 2. In the embodiment of FIG. 1, there are five of these rings 38 located at longitudinally spaced-apart locations along the length of core 20. Each ring 38 contains a body of exothermic material such as above described. The concept of confining the exothermic material in a body that has an open side facing the fusible element is not a part of the invention claimed in this application but is claimed in an application by G. Frind, application Ser. No. 483,391, assigned to the assignee of the present invention.

For igniting each body 34 of exothermic material, a thin conductive wire 45 of high resistivity is provided in good heat-transfer relation with the exothermic material. In FIG. 3, this wire 45 is shown in the form of a loop imbedded in the exothermic material. Terminal conductors 46 which are of larger diameter than the igniter wire 45, extend in sealed relation through the walls of ring 38 and are suitably joined to wire 45. When significant current is passed through the igniter wire 45, it is heated and the resultant heat is transferred to the surrounding body of exothermic material, quickly producing an exothermic reaction that very rapidly generates hot gases flowing in a radially outward direction. The fusible elements 18 and 19 are in good heat-transfer relationship with the exothermic material, and these hot gases thus quickly heat the adjacent portions of the fusible elements. This causes the fusible elements to melt in the regions adjacent the exothermic bodies, thus forming the desired multiple arcs in series. This disruption of the fusible elements is accelerated by the abruptly-developed forces produced by the hot gases acting transversely of the fusible elements in the regions of the exothermic bodies.

The igniter wires 45 are connected in series with each other between the fuse terminals 17 by a plurality of interconnecting wires 50, preferably of a high-conductivity, oxidation-resistant metal, such as silver or a silver alloy. These interconnecting wires 50, which are in coil form in order to impart the desired length, and are of substantially larger diameter than the igniter wires, are connected to the terminal conductors 46 of the igniter wires, preferably by crimp connections. The series combination of the igniter wires 45, their terminal conductors 45, and the interconnecting wires 50 may be thought of as a triggering circuit 52. This triggering circuit 52 has its opposite ends suitably electrically connected to the opposite fuse terminals 17. Accordingly, the triggering circuit provides a conductive path between the terminals parallel to the paths provided by the fusible conductors 18 and 19.

The resistance of the triggering circuit 52 is very much higher than that of any of the fusible elements 18 or 19. As a result, no significant current flows through the triggering circuit so long as one of the fusible elements 18 and 19 remains intact. But should the two fusible elements 18 and 19 be disrupted, either by melting, vaporization, or mechanical breaking, the parallel triggering circuit is the only conductive path available between the terminals and the current therethrough accordingly rises abruptly. This abrupt rise in current causes the bodies 34 of exothermic material to be heated simultaneously, thus developing the above-described exothermic reactions substantially simultaneously at each body 34 of the exothermic material.

The exothermic reaction at each body 34 not only disrupts the main fusible elements 18 and 19 in a plurality of locations along the length of the fusible elements, but it also disrupts the trigger circuit at each of the bodies 34, forming a gap within each body 34 across which an arc is developed. The short gaps at 34 continue to arc as the current heats the remainder of the trigger circuit until it too melts and arcs. The sand surrounding the trigger circuit interacts with the arcing products to effect arc extinction and, in the case of low current interruption, to develop an insulating gap capable of withstanding the applied recovery voltage. The timing for this, in the case of low currents, is designed to allow the main fusible elements to be fully severed before the trigger circuit clears the current. The withstand voltage of the gaps in the fusible elements is then high enough for them to withstand the recovery voltage and normal system voltage.

With higher currents, trigger circuit disruption and extinction of the triggering circuit arcs are very rapid, and current is commutated back to the main fusible elements where the gaps formed by ignition of the exothermic material are still relatively short. This results in continued current through the main fusible elements, but this current can be readily cleared by the main fusible elements because, being of a relatively high value, it can rapidly burn back the main fusible elements and develop gaps of sufficient length to withstand voltage after an early current zero.

My studies have shown that for high currents in the range of 20 or more times rated continuous current, the fusible elements melt and vaporize at their regions of reduced cross-section very rapidly (e.g., in less than one millisecond), and the trigger circuit makes little contribution to the interrupting process for these high currents.

There are several significant features of the illustrated fuse that should be noted at this point. One is that the trigger circuit 52 is connected between the fuse terminals 17 independently of the main fusible elements (18 and 19) that it parallels and is electrically insulated from the main fusible elements at all points along the length of the main fusible elements except at the terminals As a result, no matter where disruption ocdurs along the length of the main fusible element (18 or 19) that is last disrupted, the current that follows flows through the trigger circuit 52. Moreover, all of this follow-on current that enters the trigger circuit at one end, flows through the trigger circuit over its entire length, exiting at its opposite end. Accordingly, all of the igniter wires 45 along its length are energized and heated by this current, thus providing greater assurance that all of the bodies 34 of exothermic material will be ignited. The above is in distict contrast to the arrangement of U.S. Pat. No. 3,705,373—Cameron, where an explosive wire parallels only a portion of the main fusible element and is closely adjacent and probably touching the main fusible element. In such an arrangement, a disruption of the fusible element outside the region spanned by the explosive wire diverts no current through the explosive wire. Even when the disruption of the main fusible element is located within the spanned region, there is no assurance that all of the current entering the explosive wire at one end will exit through the other end in view of the close proximity and probably touching relationship of the explosive wire and the main fusible element. This is even clearer in the embodiment of Cameron in which the explosive wire is attached to the main fusible element at more places than at the two ends of the explosive wire.

With regard to the above referred-to electrical insulation between the trigger circuit 52 and the main fusible elements 18 and 19, it should be noted that the trigger circuit can be spaced an appreciable distance from the main fusible elements. Along the length of the trigger circuit the fusible element is separated therefrom by the sand 10, the ceramic rings 38, and the exothermic material 34, all of which are good electrical insulators. It is unnecessary for the trigger circuit 52 to be closely adjacent the fusible elements 18 and 19 because the heat that is applied to the fusible elements for initiating multiple arcs is derived from the exothermic material 34 and not directly from the trigger circuit.

Another significant feature to be noted is that when the fuse has operated to interrupt the circuit, each body 34 of exothermic material is located in a plane that extends transversely of the electric field across the arcing region. This helps prevent the exothermic material from forming a potential breakdown path along the potential gradient of the fuse. Considering this feature in more detail, it should be noted that the exothermic material, upon ignition, causes the fusible element to arc at a location aligned with the body of exothermic material; and this arc causes the fusible element to burn back away from the exothermic body, following which the arc is extinguished. The electric field between the spaced apart ends of the remaining portions of the fusible element extends between the spaced-apart ends by paths that are disposed generally longitudinally of the fusible element. The portion of the body of exothermic material that is located between the spaced ends extends transversely of the electric field.

Still another significant feature is that ignition of each body 34 of exothermic material causes all the parallel-connected main fusible elements to be broken (since all of these elements are in close proximity to the body 34). This would be the case whether the fuse includes two main fusible elements, as shown, or many more, as would be the case in a fuse with a higher current rating. Such a higher current fuse typically comprises additional ribbons wrapped around the core in parallel with those shown, with all the ribbons crossing each of the annular bodies 34 of exothermic material at circumferentially-spaced locations. When the exothermic material of body 34 ignites, each ribbon is rapidly heated to melting at the location where it crosses the exothermically reactive body 34. Since the exothermic reaction takes place with great rapidity, all the ribbons are broken substantially simultaneously.

In many applications of high voltage, current-limiting fuses, the fuse will be exposed to surge currents from switching surges and similar transient conditions. Such surge currents can produce false operation of the fuse shown in FIG. 1, because even though they are of short duration and do not supply sufficient energy to the main fusible elements to cause them to melt, they have high enough peaks to develop substantial voltages between the fuse terminals. Such voltages can sometimes drive sufficient current through the triggering circuit 52 of FIG. 1 to ignite the exothermic bodies 34. To prevent significant current from flowing through the triggering circuit under these conditions, I provide within the triggering circuit and in series therewith a breakdown gap such as shown at 60 in FIG. 5. This gap 60 comprises two spaced-apart electrodes 62 that are located within a small tubular housing 64 of insulating material. There is sufficient dielectric strength between the spaced electrodes to withstand the voltage developed between the fuse terminals by the above-described surges. Thus, these surges produce no significant current through the triggering circuit, and the trigqering circuit remains inactive, as desired.

The trigger gap 60 does not significantly interfere with the desired operation of the fuse under low overcurrent conditions. In this regard, consider the case in which the fusible element melts and then arcs at the overlay 34 in response to a persistent low overcurrent. Current flows through the arc until a natural current zero following which the usual recovery voltage transient appears across the arcing gap in the main fusible element. This gap may not be long enough at this time to have a dielectric strength as high as the trigger gap 60, in which case the recovery voltage transient would breakdown the gap in the main fusible element, reestablishing the arc that had been present. This arc would burn back the main fusible element, thus lengthening the gap in the main fusible element and allowing the arcing current to continue until another natural current zero. The recovery voltage transient that appears after each current zero would repeat this process until the main gap becomes long enough so that it would no longer breakdown in preference to the trigger gap 60. When this occurred, the trigger gap 60 would be ignited by the recovery voltage transient and current would flow through the triggering circuit to activate the exothermic bodies 34 in the manner described hereinabove.

In the case of higher overcurrents, the arc that initially forms would burn back the main fusible element sufficiently to allow the recovery voltage appearing after the first, or at least an early, current zero to ignite the gap 60 in preference to the gap in the main fusible element. After this, current would flow through the triggering circuit to activate the exothermic bodies in the manner described hereinabove.

Although only one trigger circuit (52) is shown in the illustrated embodiment, it is to be understood that it is sometimes advantageous to include a second trigger circuit in parallel with the first one. Preferably, this second trigger circuit is of the same design as the first one and has its igniter wires located in the illustrated bodies 34 of exothermic material. In such an arrangement, the current flowing after the main fusible elements are disrupted will normally divide between the two trigger circuits. If, for some reason, either one operates before the other, the resulting exothermic reactions will disrupt the other as well as the main fusible elements. As a result, the fuse operates in the basic manner intended and described hereinabove, even should a trigger circuit fail.

As noted herein above with respect to trigger circuit 52, the interconnecting wires 50 and the terminal conductors 46 are of substantially larger diameter than the igniter wires 45. This helps to assure that when significant current passes through the triggering circuit 52, the heating effect of the current will be concentrated at the igniter wires. This helps to prevent melting of the trigger circuit at locations outside the igniter wires prior to ignition of the exothermic material, which melting could prevent the desired operation of the trigger circuit. Further contributing to concentration of the heating effect at the igniter wires 45 is the fact that the igniter wires are of higher resistivity material than the connecting wires 50, e.g., tungsten as compared to silver or silver alloy, as will be noted later in this specification.

EXEMPLARY MATERIALS

The above described fuse may employ a wide variety of materials for its various components, and some of these will now be specified, but only by way of example and not limitation.

The main fusible elements 18 and 19 can be of aluminum, silver, copper, tin, zinc, or cadmium. Aluminum and silver are preferred. It is also to be noted that these elements can be of forms other than ribbon form. For example, they can be of wire form or of cylindrical form.

The triggering circuit 52 in one embodiment uses coiled interconnecting wires 50 of silver or silver alloy, igniter wire 45 of tungsten or nickel-chromium alloy, and leads 46 of nickel-chromium or copper-nickel alloys.

The exothermic material used for bodies 34 is preferably one of the materials disclosed and claimed in application Ser. No. 412,061—Johnson and Grubb, assigned to the assignee of the present invention and filed on Aug. 27, 1982. Each of these materials is a mixture of a solid oxidant, a metal in powdered form, and a suitable binder having electrical insulation properties. The metal is selected from the group consisting of zirconium, hafnium, thorium, aluminum, magnesium and combinations thereof. The oxidant comprises a material such as potassium perchlorate or other chlorates or perchlorates which react exothermically with the metal when the mixture is heated. The binder can be of colloidal silica. Despite the presence of the metal particles, this material is a fairly good electrical insulator. Preferably, the body 34 is covered with a thin coating of a moisture-resistant insulating material such as sodium silicate.

The filler 26 in the casing 10 is preferably quartz sand, but my invention in its broader aspects also applies to fuses in which the casing 10 is filled with other arc-extinguishing materials, such as oil or a suitable gas.

While I have shown and described a particular embodiment of my invention, it will be obvious to those skilled in the art that various changes and modifications may be made without departing from my invention in its broader aspects; and I, therefore, intend herein to cover all such changes and modifications as fall within the true spirit and scope of my invention.

What I claim as new is:

1. A high voltage electric fuse comprising:

(a) a pair of spaced-apart conductive terminals, (b) a fusible conductive element connected between said terminals, (c) bodies of exothermic material disposed closely adjacent to said conductive element at spaced-apart locations along the length of the conductive element, the exothermic material of each body having the property of exothermically reacting when heated to a predetermined temperature, (d) a triggering circuit connected between said terminals independently of said fusible conductive element and having a resistance that limits current therethrough to very low values until said fusible conductive element is disrupted, (e) means for connecting the bodies of exothermic material in good heat-transfer relationship with said triggering circuit and said fusible conductive element so that the heating effect of current through said triggering circuit upon disruption of said fusible conductive element causes the material of said bodies to exothermically react and thus cause further disruption of said fusible element at additional locations respectively located adjacent to said bodies, (f) and means for electrically insulating said triggering circuit from said fusible conductive element at all points along the length of said fusible element except at said terminals.

2. In a fuse as defined in claim 1, (a) a support of electrical insulating material about which said fusible conductive element is spirally wound, (b) a second fusible conductive element in addition to said first-recited fusible conductive element, said second element being connected between said terminals and spirally wound about said support in parallel-circuit relationship with said first element and in spaced-apart relationship to said first element, (c) the bodies of exothermic material generally surrounding said support and being located on said support in axially-spaced relationship along the length thereof, (d) said fusible elements passing over the exterior of said bodies in close proximity thereto.

3. The fuse of claim 2 in which each of said fusible elements passes at least once over the exterior of each of said bodies.

4. In a fuse as defined in claim 1, (a) the bodies of exothermic material being spaced apart along the length of said fusible element, (b) said fusible element passing at least once over the exterior of each of said bodies, (c) said triggering circuit including a plurality of conductive heating portions respectively located in close proximity to said plurality of bodies and electrically connected in series with each other in said triggering circuit.

5. In a fuse as defined in claim 1, (a) a support of electrical insulating material about which said fusible conductive element is spirally wound, (b) a second fusible conductive element in addition to said first-recited fusible conductive element, said second element being connected between said terminals and spirally wound about said support in parallel-circuit relationship with said first element and in spaced-apart relationship to said first element, (c) means for mounting said bodies of exothermic material on said support in axially-spaced relationship along the length of said support, (d) said fusible elements passing over said bodies in close proximity thereto.

6. The fuse of claim 5 in which each of said bodies is of generally annular form.

7. The fuse of claim 5 in which each of said fusible elements passes at least once over the exterior of each of said bodies.

8. The fuse of claim 6 in which each of said fusible elements passes at least once over the exterior of each of said bodies.

9. The fuse of claim 1 in which said triggering circuit includes a plurality of conductive heating portions respectively located in close proximity to said plurality of bodies and electrically connected in series with each other in said triggering circuit.

10. The fuse of claim 9 in which said triggering circuit further comprises interconnecting portions between said heating portions, the interconnecting portions being in the form of coiled wire.

11. The fuse of claim 1 in which at each location where said main fusible element is disrupted by an exothermic reaction, there is an electric field between the spaced portions of said fusible element remaining at said location after arcing, the portion of the associated body of exothermic material that is located between said spaced fusible element portions extending transversely of said electric field.

12. In a fuse as defined in claim 1, (a) a second fusible conductive element in addition to said first-recited fusible conductive element connected between said terminals in parallel-circuit relationship with said first element and in spaced-apart relationship to said first element, (b) each body of exothermic material being disposed closely adjacent to both said first and second fusible conductive elements at spaced-apart locations along the length of said elements, (c) the bodies of exothermic material being connected in good heat transfer relationship to both said first and second fusible elements so that the heating effect of current through said triggering circuit upon disruption of both of said fusible elements causes the material of said bodies to exothermically react and thus cause further disruption of said fusible elements at additional locations respectively located adjacent said bodies, and (d) means for electrically insulating said triggering circuit from said second fusible conductive element at all points along the length of said second fusible element except at said terminals.

13. The fuse of claim 12 in which said bodies are of a ;enerally ring shape, and said fusible conductive ele- ıents pass over the exterior of said ring-shaped bodies t spaced locations in close proximity to said exterior.

14. The fuse of claim 13 in which each of said fusible lements passes at least once over the exterior of each of aid bodies.

15. In a fuse as defined in claim 1, (a) a second triggering circuit connected between said terminals independently of said fusible conductive element and in parallel-circuit relationship with said first triggering circuit and said fusible conductive element, said second triggering circuit having a resistance that limits current therethrough to very low values until said fusible conductive element is disrupted, (b) means for connecting the bodies of exothermic material in good heat-transfer relationship with said second triggering circuit, and (c) means for electrically insulating said triggering circuit from said fusible conductive element at all points along the length of said fusible element except at said terminals.

16. The fuse of claim 1 in which said triggering circuit includes insulating means in series with the triggering circuit for blocking significant current from flowing therethrough under predetermined switching surge conditions and for breaking down to allow significant current through the triggering circuit when the voltage thereacross exceeds a predetermined level.

17. The fuse of claim 16, in which said insulating means comprises a breakdown gap.

* * * * *